US006845220B2

(12) United States Patent
Lee

(10) Patent No.: US 6,845,220 B2
(45) Date of Patent: Jan. 18, 2005

(54) DEVELOPMENT DEVICE TO DETECT A DEVELOPING GAP

(75) Inventor: Hyun-cheol Lee, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 11 days.

(21) Appl. No.: 10/459,443

(22) Filed: Jun. 12, 2003

(65) Prior Publication Data

US 2004/0018024 A1 Jan. 29, 2004

(30) Foreign Application Priority Data

Jul. 26, 2002 (KR) ..... 2002-44246

(51) Int. Cl.[7] ..... G03G 15/00
(52) U.S. Cl. ..... 399/38; 399/48; 399/55
(58) Field of Search ..... 399/38, 42, 48, 399/50, 51, 53, 55, 56

(56) References Cited

U.S. PATENT DOCUMENTS 4,862,828 A * 9/1989 Kumasaka et al. ..... 399/267
5,521,683 A 5/1996 Miyamoto et al.
2004/0018025 A1 * 1/2004 Park et al. ..... 399/55

FOREIGN PATENT DOCUMENTS

JP 5-333685 * 12/1993
JP 2003-162148 * 6/2003

* cited by examiner

*Primary Examiner*—Hoan Tran
(74) *Attorney, Agent, or Firm*—Staas & Halsey LLP

(57) ABSTRACT

A development device includes a developing gap detection function. The development device also includes an organic photoconductive body, a developer conveying body, a DC power supply, an AC power supply, a discharge start voltage detection portion, and a controller. The discharge start voltage detection portion detects a discharge start voltage occurring between the developer conveying body and the organic photoconductive body when a voltage is supplied from the power supply unit in increments at predetermined intervals. The controller obtains a developing gap between the organic photoconductive body and the developer conveying body based on the discharge start voltage detected by the discharge start voltage detection portion, and outputs a developing voltage suitable for the obtained developing gap. Accordingly, the development device having the developing gap detection function detects the developing gap easily and accurately by recognizing the discharge start voltage, and improves image quality by regulating an image forming condition.

14 Claims, 4 Drawing Sheets

DEVELOPMENT DEVICE TO DETECT A DEVELOPING GAP

CROSS REFERENCE TO RELATED APPLICATIONS

This application claims the benefit of Korean Application No. 2002-44246, filed Jul. 26, 2002, in the Korean Intellectual Property Office, the disclosure of which is incorporated herein by reference.

BACKGROUND OF THE INVENTION

1. Field of the Invention

The present invention relates to a development device employed in an image forming apparatus using an electrophotography such as an office machine, for example, a laser beam printer, a facsimile machine, a digital copier, etc., to develop an electrostatic latent image formed on an organic photoconductive drum into a toner image. More particularly, the present invention relates to a development device to detect a developing gap between a developer conveying body such as a developing roller and a photoconductive drum accurately and economically.

2. Description of the Related Art

FIG. 1 is a schematic view showing a general development device.

The development device 1 as shown in FIG. 1 includes an organic photoconductive drum 4 on which an electrostatic latent image is formed by a LSU (Laser Scan Unit) (not shown) using an electric potential of a surface thereof, a charging roller 2 to rotate in contact with the organic photoconductive drum 4 to electrically charge a surface of the organic photoconductive drum 4, and a developer conveying body 5 (hereinafter referred to as "developing roller") to rotate opposite to the organic photoconductive drum 4, and to add a developer made of a predetermined color toner to the electrostatic latent image formed on the organic photoconductive drum 4 to form a visible image.

The developing device also includes a developer supplying roller 6 to supply the developer to the developing roller 5, a developer amount regulating member 7 to regulate a developer layer formed on the developing roller 5, a cleaning blade 10 to remove a remainder developer that remains on the surface of the organic photoconductive drum 4 after the organic photoconductive drum 4 is rotated in one cycle, and a power supply unit 20 to supply a power to the organic photoconductive drum 4, the developing roller 5, and the developer amount regulating member 7.

Hereinbelow, an operation of an image forming apparatus having the development device 1 as constructed above will be described.

The charging roller 2 electrically and uniformly charges the surface of the organic photoconductive drum 4 to a predetermined voltage. Afterwards, the LSU converts a digital signal input from a computer or a scanner to an optical signal in a form of a laser beam through a laser diode. The LSU then emits the optical signal onto the organic photoconductive drum 4, thereby forming the electrostatic latent image on the organic photoconductive drum 4.

The developer supplied to the developing roller 5 is conveyed to a developing gap G between the organic photoconductive drum 4 and the developing roller 5 while the developing roller 5 is rotated. At this point, the developer amount regulating member 7 disposed above the developing roller 5 maintains a toner layer of the developer on a surface of the developing roller 5 at a predetermined thickness.

As the organic photoconductive drum 4 is rotated, the developer 8 jumps onto the electrostatic latent image formed on the organic photoconductive drum 4 due to an electrical potential difference that occurs between the electrostatic latent image and the surface of the developing roller 5, thereby developing the electrostatic latent image formed on the surface of the organic photoconductive drum 4 into a visible toner image.

Meanwhile, when incoming paper enters between the organic photoconductive drum 4 on which the toner image is formed and a transfer roller (not shown) disposed at a lower portion of the organic photoconductive drum 4, the transfer roller transfers the toner image from the organic photoconductive drum 4 to the paper.

While the organic photoconductive drum 4 is continuously rotated, the cleaning blade 10 removes the remainder developer from the surface of the organic photoconductive drum 4, enabling the next electrostatic latent image to be formed on the organic photoconductive drum 4. The toner image is settled down on the paper by heat and pressure and is then discharged out of the development device 1 so that a series of image forming processes are completed.

For the image forming apparatus as described above, it is important to maintain a constant developing gap G between the organic photoconductive drum 4 and the developing roller 5 because the constant developing gap G guarantees uniform and stable developing quality during the process of developing the electrostatic latent image on the organic photoconductive drum 4 into the toner image using the developer 8.

FIG. 2 is a front view showing a development device 1 of a conventional image forming apparatus. As shown in FIG. 2, the development device has a spacer 5*a* including two spacer rolls that are disposed at both ends of a shaft 5*b* of the developing roller 5, which are rotated in contact with the surface of the organic photoconductive drum 4. The spacer 5*a* is provided to maintain a predetermined developing gap G between the organic photoconductive drum 4 and the developing roller 5.

Since the spacer 5*a* has an outer diameter that is larger than an outer diameter of the developing roller 5, the organic photoconductive drum 4 and the developing roller 5 opposing each other that are respectively rotated by an organic photoconductive drum gear 4*a* and a developing roller gear 5*c* at a predetermined linear velocity rate, maintain the predetermined developing gap G therebetween. When the developing gap G is expressed by an outer diameter D1 of the developing roller 5, an outer diameter D2 of the spacer 5*a*, an outer diameter D3 of the shaft 5*b*, and an inner diameter D4 of the spacer 5*a*, the developing gap G is defined by (D2-D1)/2-(D4-D3)/2.

However, there still occurs a variation in the developing gap G due to a precision in the sizes of the above-related components. A variation of the developing gap G results in a deteriorated image quality. That is, as the developing gap G becomes larger, a developing electric field becomes weaker and thus, an image density becomes lowered. As the developing gap G becomes narrower, the developing electric filed becomes stronger, subsequently increasing the image density, and even worse, causing electric discharge and subsequent image noise. Therefore, in order to solve these problems, the development device has to detect a predetermined developing gap and properly vary the developing electric field according to the detected developing gap.

Accordingly, a technology has been suggested to detect the image density using an optical sensor based on a reference image previously formed on the organic photoconductive drum or transfer belt. However, fabrication costs are high due to a cost of the optical sensor.

U.S. Pat. No. 5,521,683 discloses a technology that detects a developing gap by supplying a constant voltage and a constant current, which has a lowered accuracy since voltage change and current change are frequently made due to the variation of the developing gap.

SUMMARY OF THE INVENTION

Accordingly, it is an aspect of the present invention to provide a development device to detect a developing gap between a developing roller and an organic photoconductive drum accurately and economically.

Additional aspects and advantages of the invention will be set forth in part in the description which follows and, in part, will be obvious from the description, or may be learned by practice of the invention.

The foregoing and/or other aspects of the present invention are achieved by providing a development device having a developing gap detection function including an organic photoconductive body to form an electrostatic latent image, a developer conveying body to rotate opposite to the organic photoconductive body and to add a developer to the electrostatic latent image formed on the organic photoconductive body to form a visible image. The development device also includes a power supply unit having a DC power supply and an AC power supply to respectively supply a DC voltage and an AC voltage to the organic photoconductive body and the developer conveying body, and a discharge start voltage detection portion to detect a discharge start voltage occurring between the developer conveying body and the organic photoconductive body when a voltage is supplied from the power supply unit in a gradual increment at predetermined intervals. The development device includes a controller to obtain a developing gap between the organic photoconductive body and the developer conveying body based on the discharge start voltage detected by the discharge start voltage detection portion.

According to an aspect of the invention, the power supply unit supplies a DC voltage only.

According to an aspect of the invention, the power supply unit may supply a superimposed voltage of the DC and the AC voltages instead.

According to another aspect of the invention, the controller controls to obtain a developing voltage suitable for the developer conveying body based on the obtained developing gap, and to supply the developing voltage to the developer conveying body.

According to yet another aspect of the invention, the development device further includes a voltage detection portion to detect an output AC voltage of the AC power supply, and a constant voltage control circuit to feed a detected AC voltage back to the AC power supply to maintain the AC voltage as a target voltage value when the electrostatic latent image is developed. The controller controls the constant voltage control circuit to supply the developing voltage suitable for the developer conveying body.

According to an aspect of the invention, based on the obtained developing voltage, the controller controls an image forming condition including at least a charging voltage to electrically charge a photoconductive drum, an intensity of light emitted from a light exposure device and an on-time measurement.

BRIEF DESCRIPTION OF THE DRAWINGS

The above and/or other aspects and advantages of the invention will become apparent and more appreciated from the following description of the preferred embodiments, taken in conjunction with the accompanying drawings of which.

DETAILED DESCRIPTION OF THE PREFERRED EMBODIMENT

Figure 1:
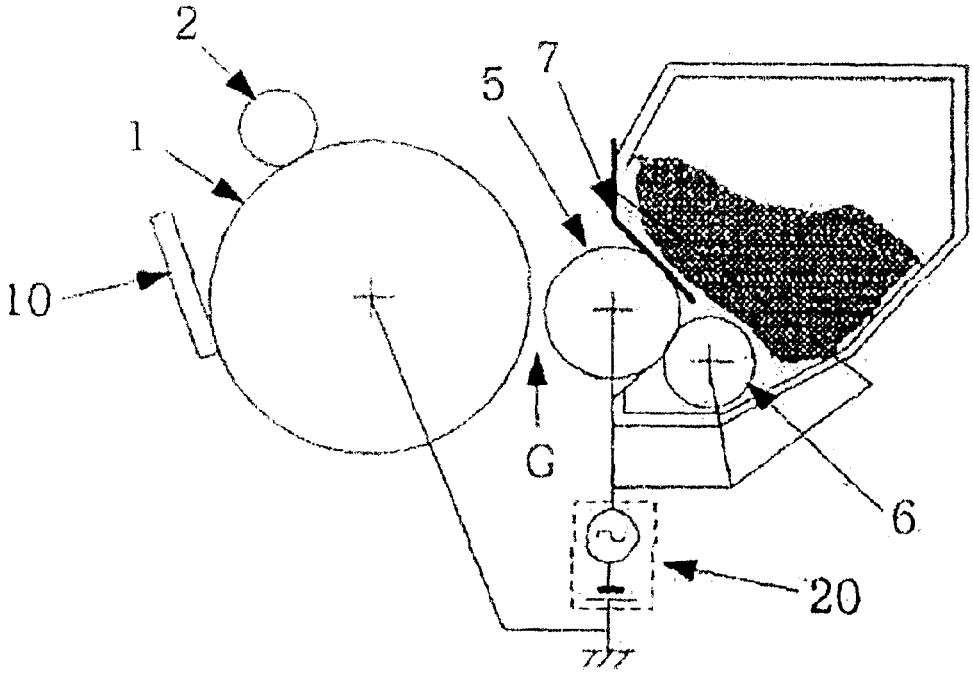
FIG. 1 (PRIOR ART)
FIG. 1 is a schematic view showing a conventional development device.
Figure 2:
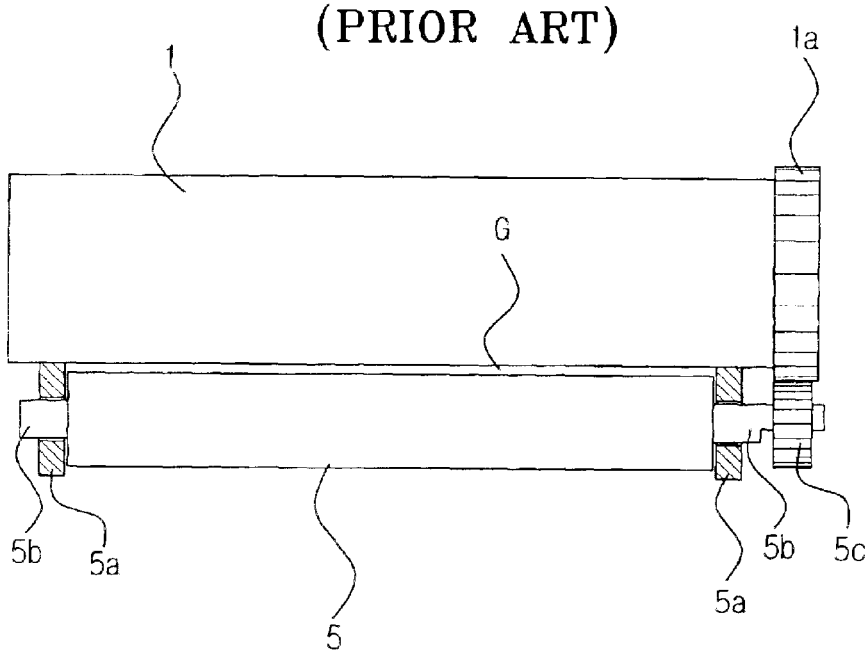
FIG.2 (PRIOR ART)
FIG. 2 is a front view showing the developing device of FIG. 1.
Figure 3:
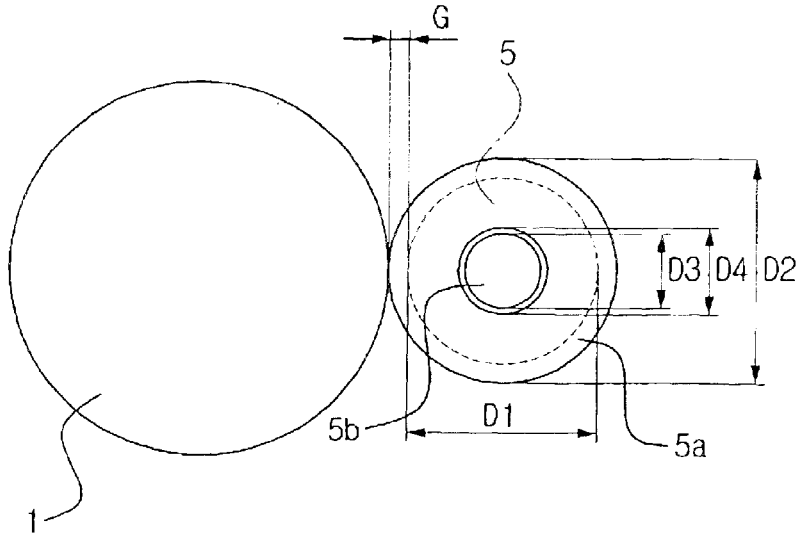
FIG.3 (PRIOR ART)
FIG. 3 is a side section view showing the developing device of FIG. 2.

Reference will now be made in detail to the present preferred embodiments of the present invention, examples of which are illustrated in the accompanying drawings, wherein like reference numerals refer to like elements throughout.

Figure 4:
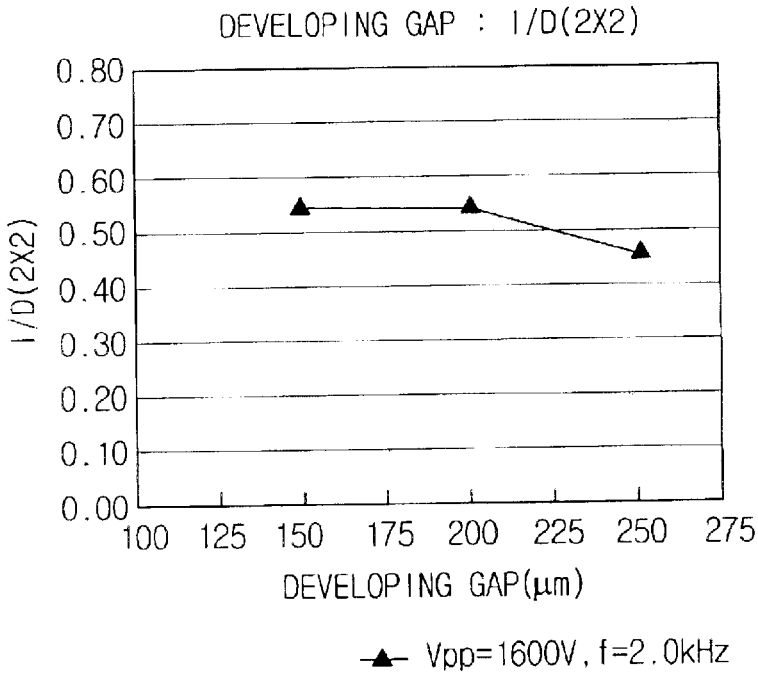
FIG. 4 is a graph showing a relationship between an image quality and a developing gap, according to the present invention.

FIG. 4 is a graph showing a relationship between an image quality and a developing gap, according to the present invention. As shown in FIG. 4, as the developing gap increases, an image density decreases and thus, deteriorates the image quality. Accordingly, in order to obtain a uniform image quality, a voltage has to be supplied under a proper developing electric field condition according to each developing gap. Also, by adjusting an image forming condition according to a variation and difference of the developing gaps, a variation of the image density and a line depth may be restrained and image noise may be prevented.

Figure 5:
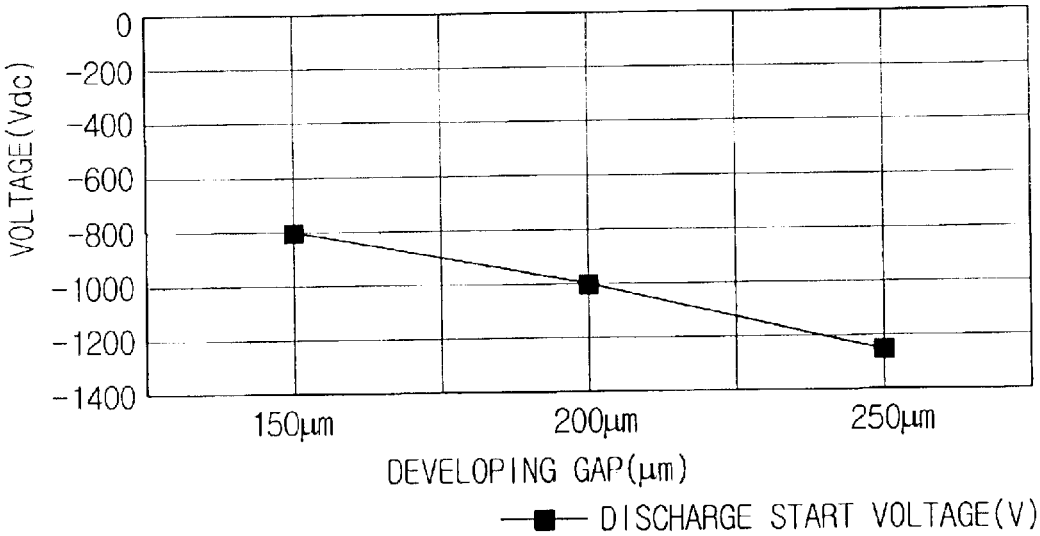
FIG. 5 is a graph showing a relationship between a discharge start voltage and a developing gap, according to the present invention.

FIG. 5 is a graph showing a relationship between a discharge start voltage and the developing gap. In order to explain the relation between the discharge start voltage and the developing gaps, the discharge start voltage occurring between a developing roller and a photoconductive drum is measured by stepwise-increasing a power supply (a DC voltage or a superimposed voltage of DC and AC voltages) to the developing roller from 0V to −1,500V.

As a result, the discharge start voltage is changed nearly to a linear shape in an interval ranging from a developing gap 150 $\mu$m to 300 $\mu$m. Accordingly, it is possible to accurately detect the developing gap of a development device used in an image forming apparatus by detecting the discharge start voltage.

Figure 6:
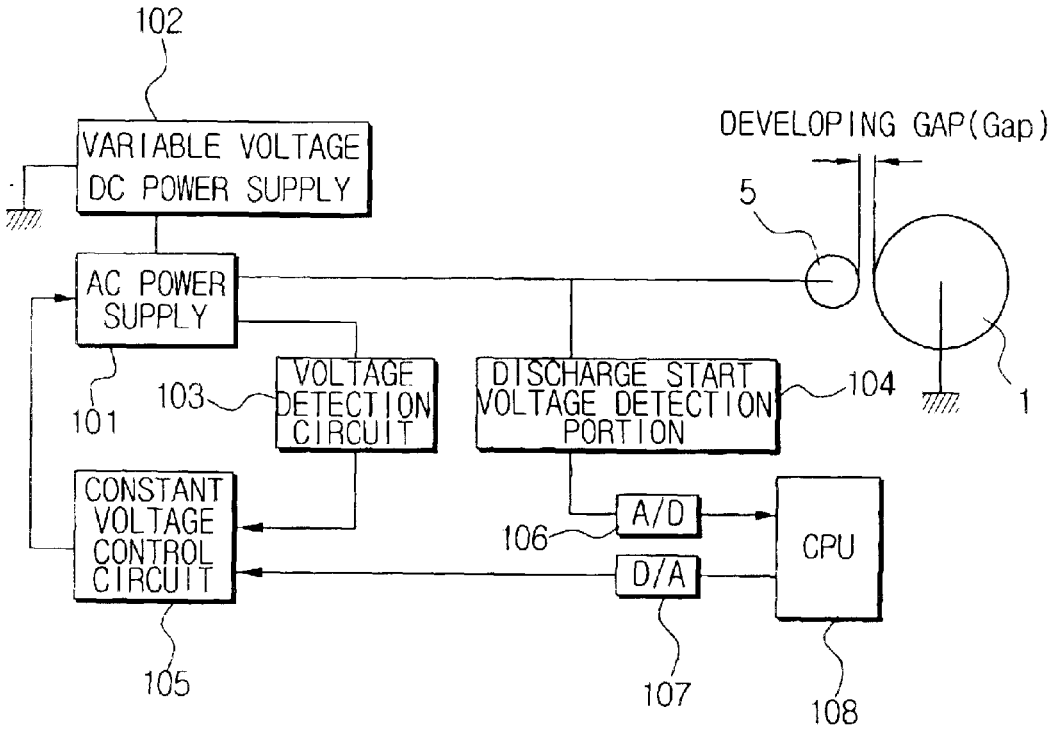
FIG. 6 is a block diagram showing a development device, according to an embodiment of the present invention.

FIG. 6 is a block diagram showing a power supply unit of a development device having a developing gap detection function, according to an embodiment of the present invention. As shown in FIG. 6, a power supply unit includes a variable voltage AC power supply 101, a variable voltage DC power supply 102, a voltage detection circuit 103, a discharge start voltage detection portion 104, a constant-voltage control circuit 105, an A/D converter 106, a D/A converter 107 and a CPU 108.

After an electrostatic latent image of a predetermined area is formed on an organic photoconductive drum 1, a predetermined voltage is supplied to a developing roller 5. Here, only the DC voltage is supplied by the variable voltage DC power supply 102, or, a superimposed voltage of the DC and the AC voltages is supplied by the variable voltage AC power supply 101 and the variable voltage DC power supply 102.

The variable voltage DC power supply 102 supplies a voltage, while stepwise-increasing the voltage from 0V to −1,500V. Also, the AC power supply 101 uses a square wave of Vpp ranging from 1.0 KV to 3.0 KV, and a frequency ranging from 1.5 to 3.0 KHz.

The constant voltage control circuit 105 receives an output AC voltage from the variable voltage AC power supply 101 through the voltage detection circuit 103. Then, the constant voltage control circuit 105 feeds the output AC voltage back to the variable voltage AC power supply 101 to maintain it as a target voltage that is used when the electrostatic latent image is developed.

The discharge start voltage detection portion 104 detects a discharge start voltage that occurs between the developing roller 5 and the photoconductive drum 1 when the voltage is supplied from the variable voltage DC power supply 102 in the stepwise increment from 0V to −1,500V. Since the discharge start voltage is changed nearly to a linear shape with respect to the developing gap, the developing gap may be accurately obtained by the detection of the discharge start voltage.

The detected discharge start voltage is supplied to the CPU 108 through the A/C converter 106. The CPU 108 obtains the developing gap based on the detected discharge start voltage, and searches a voltage condition suitable for the obtained developing gap to supply the voltage to the developing roller 5. More specifically, the CPU 108 calculates a developing voltage Vo by using a predetermined function (for example, Vo=f(v), where v denotes the discharge start voltage), or, obtains the developing voltage Vo using a table matching method using a table that is established in advance.

When an image to be printed is output, the CPU 108 supplies the obtained developing voltage Vo as the superimposed voltage of the DC and the AC voltages. Accordingly, when the electrostatic latent image is developed, a sleeve is supplied with a periodic bias voltage that is obtained by superimposing the DC and AC voltage.

Also, the CPU 108 may adjust the image forming conditions such as the image density and the line width through a series of processes. The adjustments of the image forming conditions are possible by adjusting a peak-to-peak voltage of an AC voltage component of the AC power supply 101, a duty ratio, a frequency, the DC superimposed value, a charging voltage to charge the photoconductive drum 1, a light intensity of a light exposure device and an on-time measurement.

Since the technology of changing the image forming condition according to the developing voltage are generally known, descriptions thereof will be omitted.

According to the present invention, even when an expensive optical sensor to measure the image density is not used, the development device having the developing gap detection function detects the developing gap accurately by recognizing the discharge start voltage occurring when the variable DC or the superimposed voltage of the DC and the AC voltages is supplied. Also, by varying the image density condition, the image quality may be easily improved.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A development device having a developing gap detection function, comprising:

an organic photoconductive body to form an electrostatic latent image;

a developer conveying body to rotate opposite to the organic photoconductive body and to add a developer to the electrostatic latent image formed on the organic photoconductive body to form a visible image;

a power supply unit to supply a voltage to the organic photoconductive body and the developer conveying body;

a discharge start voltage detection portion to detect a discharge start voltage occurring between the developer conveying body and the organic photoconductive body when the voltage is supplied from the power supply unit in increments at predetermined intervals; and a controller to obtain a developing gap between the organic photoconductive body and the developer conveying body based on the discharge start voltage detected by the discharge start voltage detection portion.

2. The development device according to claim 1, wherein the power supply unit further comprises:

a DC power supply to supply a DC voltage and an AC power supply to supply an AC voltage, to the organic photoconductive body and the developer conveying body.

3. The development device according to claim 2, wherein the power supply unit supplies a superimposed voltage of the DC and the AC voltages.

4. The development device according to claim 2, further comprising:

a voltage detection portion to detect an output AC voltage of the AC power supply; and a constant voltage control circuit to feed the detected AC voltage back to the AC power supply to maintain the AC voltage as a target voltage value when the electrostatic latent image is developed, wherein the controller controls the constant voltage control circuit to supply the developing voltage suitable for the developer conveying body.

5. The development device according to claim 4, wherein the controller supplies the developing voltage suitable for the developer conveying body to output the visible image from the development device.

6. The development device according to claim 2, wherein the voltage supplied from the power supply unit in the increments at the predetermined interval is provided from the DC power supply in stepwise increments from 0V to −1500V.

7. The development device according to claim 2, wherein the AC voltage supplied from the AC power supply ranges from 1.0 KV to 3.0 KV.

8. The development device according to claim 1, wherein the controller obtains a developing voltage suitable for the developer conveying body based on the obtained developing gap, and supplies the developing voltage to the developer conveying body.

9. The development device according to claim 1, wherein, based on the obtained developing voltage, the controller controls an image forming condition including at least one of a charging voltage to electrically charge a photoconductive drum, an intensity of light emitted from a light exposure device and an on-time of light emitted from the light exposure device for one dot.

10. The development device according to claim 1, wherein the power supply unit further comprises:

a DC power supply to supply a DC voltage only, to the organic photoconductive body and the developer conveying body.

11. A method of detecting a developing gap using a developing gap detection function of a development device which includes an organic photoconductive body to form an electrostatic latent image and a developer conveying body to rotate opposite to the organic photoconductive body and to add a developer to the electrostatic latent image formed on the organic photoconductive body to form a visible image, the method comprising:

supplying a voltage to the organic photoconductive body and the developer conveying body;

detecting a discharge start voltage occurring between the developer conveying body and the organic photoconductive body when the voltage is supplied in increments at predetermined intervals;

obtaining a developing gap between the organic photoconductive body and the developer conveying body based on the detected discharge start voltage; and obtaining a developing voltage suitable for the developer conveying body based on the obtained developing gap to supply the developing voltage to the developing conveying body so that the visible image is output from the development device.

12. The method according to claim 11, wherein the supplying the voltage further comprises:

supplying a DC voltage and an AC voltage, to the organic photoconductive body and the developer conveying body.

13. The method according to claim 12, further comprising:

detecting an output AC voltage of the AC power supply; and feeding the detected AC voltage back to the AC power supply to maintain the AC voltage as a target voltage value when the electrostatic latent image is developed.

14. The method according to claim 11, wherein the supplying the voltage further comprises:

supplying a DC voltage only, to the organic photoconductive body and the developer conveying body.

* * * * *